US012546196B2

(12) United States Patent
Seliukou et al.

(10) Patent No.: US 12,546,196 B2
(45) Date of Patent: Feb. 10, 2026

(54) PCP SYSTEM WITH A HORIZONTALLY ORIENTED PMM

(71) Applicant: Schlumberger Technology Corporation, Sugar Land, TX (US)

(72) Inventors: Andrei Seliukou, Calgary (CA); Sharanpreet Singh, Calgary (CA); Benigno Segundo Montilla Jimenez, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/659,967

(22) Filed: May 9, 2024

(65) Prior Publication Data

US 2025/0347207 A1 Nov. 13, 2025

(51) Int. Cl.

| | |
|---|---|
| ***F04C 15/00*** | (2006.01) |
| ***E21B 33/03*** | (2006.01) |
| ***E21B 33/068*** | (2006.01) |
| ***E21B 43/12*** | (2006.01) |
| ***F04C 13/00*** | (2006.01) |
| *F04C 2/107* | (2006.01) |

(52) U.S. Cl.

CPC ..... *E21B 43/126* (2013.01); *E21B 33/03* (2013.01); *E21B 33/068* (2013.01); *F04C 15/0061* (2013.01); *F04C 15/008* (2013.01); *F04C 2/1071* (2013.01); *F04C 13/008* (2013.01); *F04C 2240/40* (2013.01)

(58) Field of Classification Search

None

See application file for complete search history.

(56) References Cited

U.S. PATENT DOCUMENTS

| | | | | | |
|---|---|---|---|---|---|
| 5,370,179 | A * | 12/1994 | Mills | E21B 43/126 | 166/68.5 |
| 6,039,115 | A * | 3/2000 | Mills | E21B 43/126 | 188/82.1 |
| 6,113,355 | A * | 9/2000 | Hult | F04C 14/06 | 417/214 |
| 6,125,931 | A * | 10/2000 | Hult | E21B 43/126 | 166/77.51 |
| 8,550,218 | B2 * | 10/2013 | Villa | F16D 65/14 | 188/106 P |
| 2001/0021351 | A1 * | 9/2001 | Kobensen | F04C 13/008 | 418/206.1 |
| 2007/0292277 | A1 * | 12/2007 | Grenke | E21B 43/126 | 417/212 |
| 2009/0032240 | A1 | 2/2009 | Boyles | | |
| 2019/0277281 | A1 * | 9/2019 | Klotz | F04C 13/008 | |
| 2022/0178368 | A1 * | 6/2022 | Montilla Jimenez | F04C 14/08 | |

FOREIGN PATENT DOCUMENTS

| | | | | |
|---|---|---|---|---|
| CA | 2239641 | A1 * | 12/1999 | E21B 43/126 |
| WO | 9221044 | A2 | 11/1992 | |

* cited by examiner

*Primary Examiner* — Blake Michener

(74) *Attorney, Agent, or Firm* — Jeffrey D. Frantz

(57) ABSTRACT

A progressive cavity pump system including a pump string disposed in a wellbore. The pump string includes a progressive cavity pump and a rod string, wherein the rod string is rotatable about a rod string axis to rotate a rotor of the progressive cavity pump. The progressive cavity pump system includes a permanent magnetic motor ("PMM") configured to drive the rotation of the rod string. The PMM is oriented such that a drive shaft of the PMM rotates about a drive shaft axis that is not coaxial with the rod string axis.

15 Claims, 4 Drawing Sheets

PCP SYSTEM WITH A HORIZONTALLY ORIENTED PMM

BACKGROUND

Field

The present disclosure generally relates to a permanent magnet motor to rotate the rotor of a progressive cavity pump (PCP).

Description of the Related Art

Oil and gas wells utilize a borehole drilled into the earth and subsequently completed with equipment to facilitate production of desired fluids from a reservoir. Subterranean fluids, such as oil, gas, and water, are often pumped or "lifted" from wellbores by the operation of downhole pumps, for example progressive cavity pumps (PCPs). A PCP includes an external helical rotor that rotates inside a double internal helical stator. In use, fluid is displaced from the intake at the bottom of the pump to the discharge at the top through a series of cavities that form between the rotor and stator as the rotor rotates, e.g., clockwise, within the stator. The rotor is attached to a lower end of a rod string. This rod string is driven by a motor located at the surface.

Drive units are coupled to the well head and are used to move the rod string to drive the rotor. Conventional drive units, however, obstruct access to the wellhead. There is a need in the art for a drive unit that allows greater access to the wellhead to allow for a second string to be present in the wellbore.

SUMMARY

In one embodiment, a progressive cavity pump system includes a pump string disposed in a wellbore. The pump string includes a progressive cavity pump and a rod string, wherein the rod string is rotatable about a rod string axis to rotate a rotor of the progressive cavity pump. The progressive cavity pump system includes a permanent magnetic motor configured to drive the rotation of the rod string. The PMM is oriented such that a drive shaft of the PMM rotates about a drive shaft axis that is not coaxial with the rod string axis.

In one embodiment, a progressive cavity pump system comprises a pump string disposed in a wellbore and a permanent magnetic motor. The pump string including a progressive cavity pump and a rod string, wherein the rod string is rotatable about a first axis to rotate a rotor of the progressive cavity pump. The permanent magnetic motor being configured to drive rotation of the rod string, wherein the permanent magnetic motor is oriented such that a drive shaft of the permanent magnetic motor rotates about a second axis that is not coaxial with the first axis.

In one embodiment, a wellhead drive unit comprises a permanent magnetic motor, a rotary shaft, a first gear, and a second gear. The permanent magnetic motor includes a drive shaft rotatable about a first axis. The tubular shaft includes an outer surface and a first inner surface defining a first bore, the tubular shaft rotatable about a second axis that is substantially perpendicular to the first axis, and wherein the tubular shaft is configured to receive a rod string. The rotary shaft is rotationally connected to the drive shaft, wherein rotation of the drive shaft rotates the rotary shaft about the first axis. The first gear is rotationally connected to the rotary shaft, wherein rotation of the rotary shaft causes the first gear to rotate about the first axis. The second gear is engaged with the first gear and rotationally connected to the tubular shaft, wherein rotation of the first gear causes the second gear and the tubular shaft to rotate about the second axis.

A wellhead drive unit comprises a frame, a permanent magnetic motor, and a gearbox. The frame comprising a base and at least one motor support. The permanent magnetic motor comprising a drive shaft that is rotatable about a first axis, a frame mount mounted to the at least one motor support, and a face mount. The gearbox being mounted to the base, the gearbox comprising a housing, a rotary shaft, a tubular shaft, a first bearing assembly, and a second bearing assembly. The housing defining an interior chamber configured to receive a lubricant, the housing comprising a gearbox mount, and wherein the face mount of the PMM is mounted to the gearbox mount. The rotary shaft is disposed in the housing and rotationally connected to the drive shaft, wherein the drive shaft and rotary shaft rotate about the first axis. The first bearing assembly comprises a first bearing and a second bearing, wherein the rotary shaft is disposed within first bearing and the second bearing. The tubular shaft comprises an outer surface and an inner surface defining a bore, wherein the bore is configured to receive a portion of a rod string, and wherein the tubular shaft is rotatable about a second axis, the second axis being substantially perpendicular to the first axis. The first gear is rotationally connected to the rotary shaft, wherein rotation of the rotary shaft causes the first gear to rotate about the first axis. The second gear is engaged with the first gear and rotationally connected to the tubular shaft, wherein rotation of the first gear causes the second gear and the tubular shaft to rotate about the second axis. The second bearing assembly comprises a thrust bearing, a first radial bearing, and a second radial bearing, wherein the tubular shaft is disposed within the thrust bearing, first radial bearing, and the second radial bearing.

In one embodiments, a method of operating a progressive cavity pump system comprises rotating a drive shaft of a permanent magnetic motor about a first axis. The method further comprises transferring rotational power of the drive shaft to a rod string of a pump string disposed in a wellbore, thereby rotating the rod string about a second axis to rotate a rotor of a progressive cavity pump disposed at an end of the pump string, wherein the second axis is not coaxial with the first axis.

BRIEF DESCRIPTION OF DRAWINGS

The appended figures illustrate only exemplary embodiments and are therefore not to be considered limiting of the scope of the disclosure, as the disclosure may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Aspects of the present disclosure provide systems, apparatus, and methods for a wellhead drive unit including a PMM oriented such that a drive shaft of the PMM rotates about an axis that is not coaxial with or parallel to the axis of rotation of a rod string coupled to the rotor of a progressive cavity pump.

Figure 1:
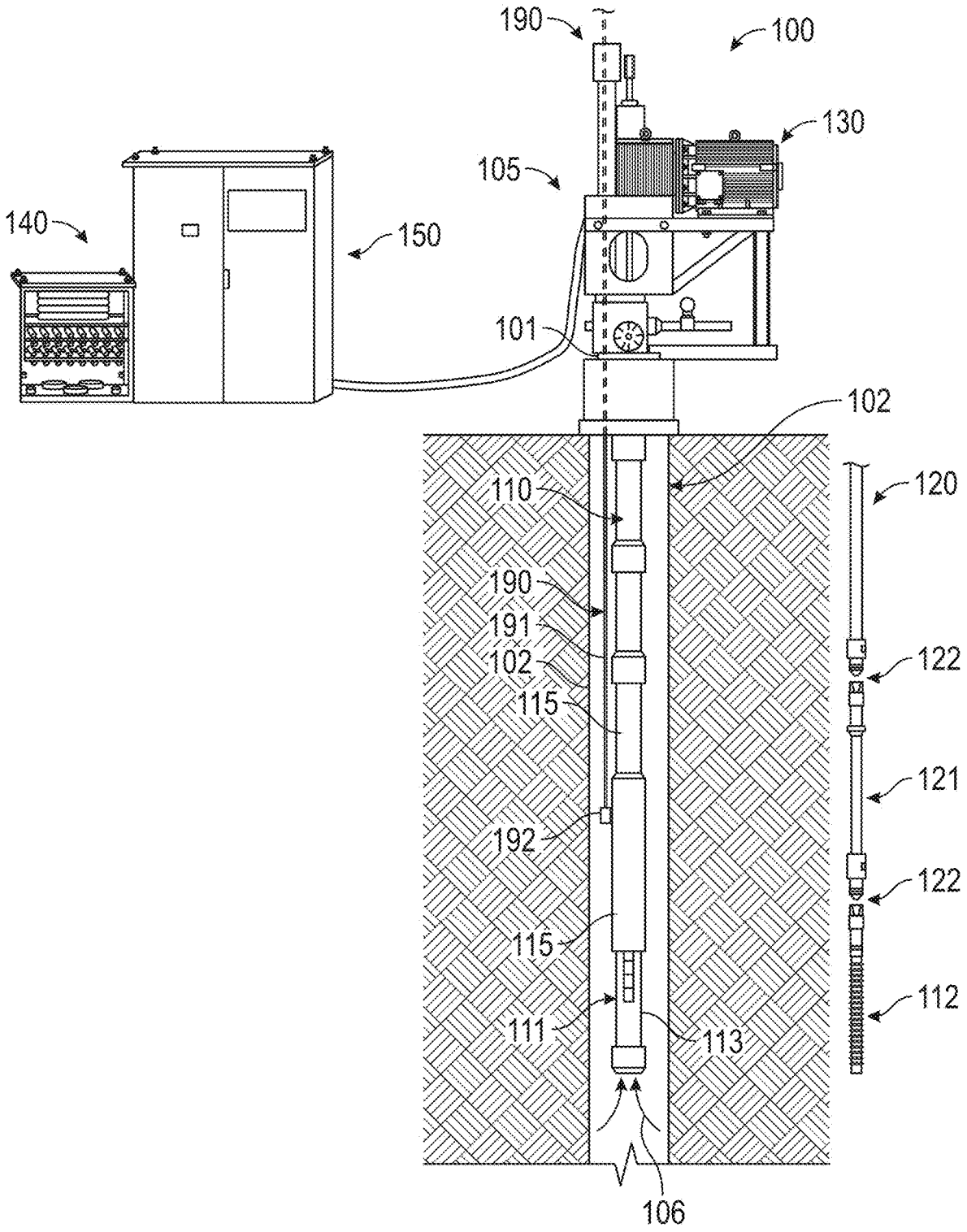
FIG. 1 illustrates a schematic view of a PCP system, according to one or more embodiments of the disclosure.

FIG. 1 illustrates a schematic view of an exemplary PCP system 100 according to the present disclosure. The PCP system 100 includes a wellhead 101, a wellhead drive assembly 105 coupled to the wellhead 101, a PCP string 110, and a rod string 120. The wellhead drive assembly 105 includes a wellhead drive unit 130, a variable-frequency drive (VFD) 150. The PCP system 100 may be controlled by a well manager or control system. The PCP system 100 according to the present disclosure can include any one or more of these components.

In the illustrated configuration, the PCP string 110 is connected to a wellhead 101 and disposed in a well 102, such as a cased well. The PCP string 110 includes a PCP 111 (having a rotor 112 rotatably disposed in a stator 113) disposed at the end of a tubing 115 that is coupled to the wellhead 101 at one end. The rod string 120, such as a sucker rod string, is disposed in the PCP string 110. The rod string 120 is shown outside of the PCP string 110 in FIG. 1 for illustration purposes. The rod string 120 includes sucker rods 121.

In some embodiments, the PCP 111 includes a helical rotor 112 that rotates inside a helical stator 113. During operation, a fluid 106 (e.g., production fluid) in the well 102 is transferred from an intake at the bottom of the PCP 111 to a discharge or outlet at the top of the PCP 111 through a series of cavities that form between the rotor 112 and stator 113 as the rotor 112 rotates, e.g., clockwise, within the stator 113. The fluid is lifted uphole through the tubing 115 and exits the wellhead 101. The rotor 112 of the PCP 111 is rotationally connected to lower end of the rod string 120. In other words, rotation of the rod string 120 causes the rotation of the rotor 112.

The drive unit 130 is disposed at the surface of the well and is coupled to the wellhead 101, such as being attached to a stuffing box and blowout preventer of the wellhead 101. The rod string 120 extends between and connects (e.g., physically and/or operatively connect) surface components of the PCP system 100, such as the drive unit 130, and downhole components of the PCP system 100, such as the PCP 111. The drive unit 130 drives the rotation of the rod string 120, which in turn rotates or cause rotation of the rotor 112.

The drive unit 130 of the present disclosure includes a PMM motor (see PMM 210 shown in FIG. 2A) as the prime mover rather than a conventional electric motor as is typically used in a traditional PCP system. Drive units with a conventional electric motor include a friction brake system to control the backspin of the sucker rod. A conventional electric motor therefore cannot control backspin and torque. In contrast, the PMM 210 does not include an internal brake. Instead, the PCP system 100 includes a VFD 150 that applies a DC brake/AC brake to the PMM 210. For example, the VFD 150 may include a brake resistor cabinet 140 to apply the brake, such as DC brake or AC brake, to the PMM 210. Backspin and/or torque of the PMM 210 can therefore be controlled by current supplied to the VFD 150. The PMM 210 allows the rod string 120, and thus the rotor 112 of the PCP 111, to be selectively rotated in a clockwise direction and in the counter-clockwise direction.

Counter rotation of conventional sucker rods can loosen or disconnect connections, e.g., threaded connections, between individual sucker rods in the sucker rod string or between the rotor 112 and the sucker rod. The rod string 120 may include high torque connections 122 between a sucker rod 121 and the rotor 112, between a sucker rod 121 and surface components, and/or between sucker rods 121. The high torque connection 122 may be a dovetail joint between a tapered projection on one sucker rod 121 that interfaces with a corresponding recess on another sucker rod 121. The high torque connection 122 allows for the sucker rod 121 to transfer more torque than conventional sucker rod strings, but also allows for the rod string 120 to be rotated both clockwise and counterclockwise with reduced risk of the rod string 120 separating. An example of sucker rods 121 configured for high torque connections 122 including dovetail joints that can be included in the PCP system 100 according to the present disclosure are EHT® rods available from Exceed Oilfield Equipment. However, other configurations for the high torque connections 122 are also possible, for example, other types and configurations of joints and connections that separate or isolate circumferential forces on the joints or connections from axial forces on the joints or connections.

The PCP system 100 can include a second string 190. For example, the drive unit 130 is configured such that a second string 190 may be disposed in the well 102 or run into the well 102 through the wellhead 101. The second string 190 is shown as including a wireline 191 that extends through the wellhead 101 and into the annulus between well 102 and the PCP string 110. A wireline tool 192 is shown attached to the end of the wireline 191. Thus, the second string 190 may be used to deploy a wireline tool 192 to conduct operations while the drive unit 130 is attached to the wellhead 101 and while fluid 106 is pumped to the surface. The wireline tool 192 may be, for example, a sensor tool configured to transmit data to the surface about the conditions of the wellbore. In some embodiments, the second string 190 may be a slick line that is deployed into the wellbore 102 through the wellhead 101. In some embodiments, the second string 190 may be coiled tubing to facilitate introducing chemicals into the wellbore 102 at a desired depth instead of depending on gravity to cause the chemicals to migrate downhole. The second string 190, such as the wireline 191, is partially disposed in an access tubular (such as access tubular 290 shown in FIGS. 2A-2C). The access tubular is a hollow tubular connected to the wellhead 101 that allows the second string 190 to be disposed or run into the well 102 through the wellhead 101.

Figure 2A:
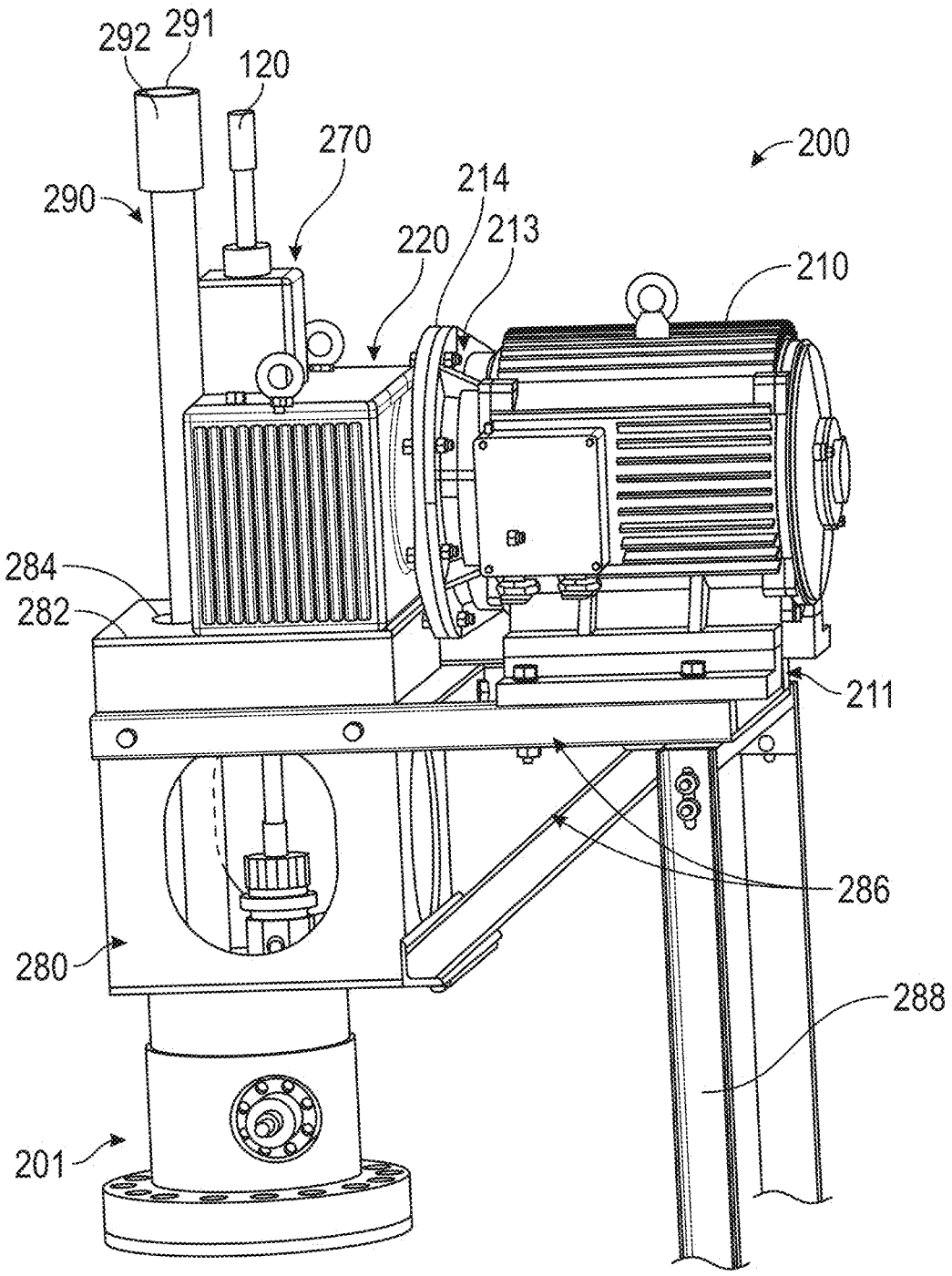
FIG. 2A illustrates a perspective view of a drive unit, according to one or more embodiments of the disclosure.
Figure 2B:
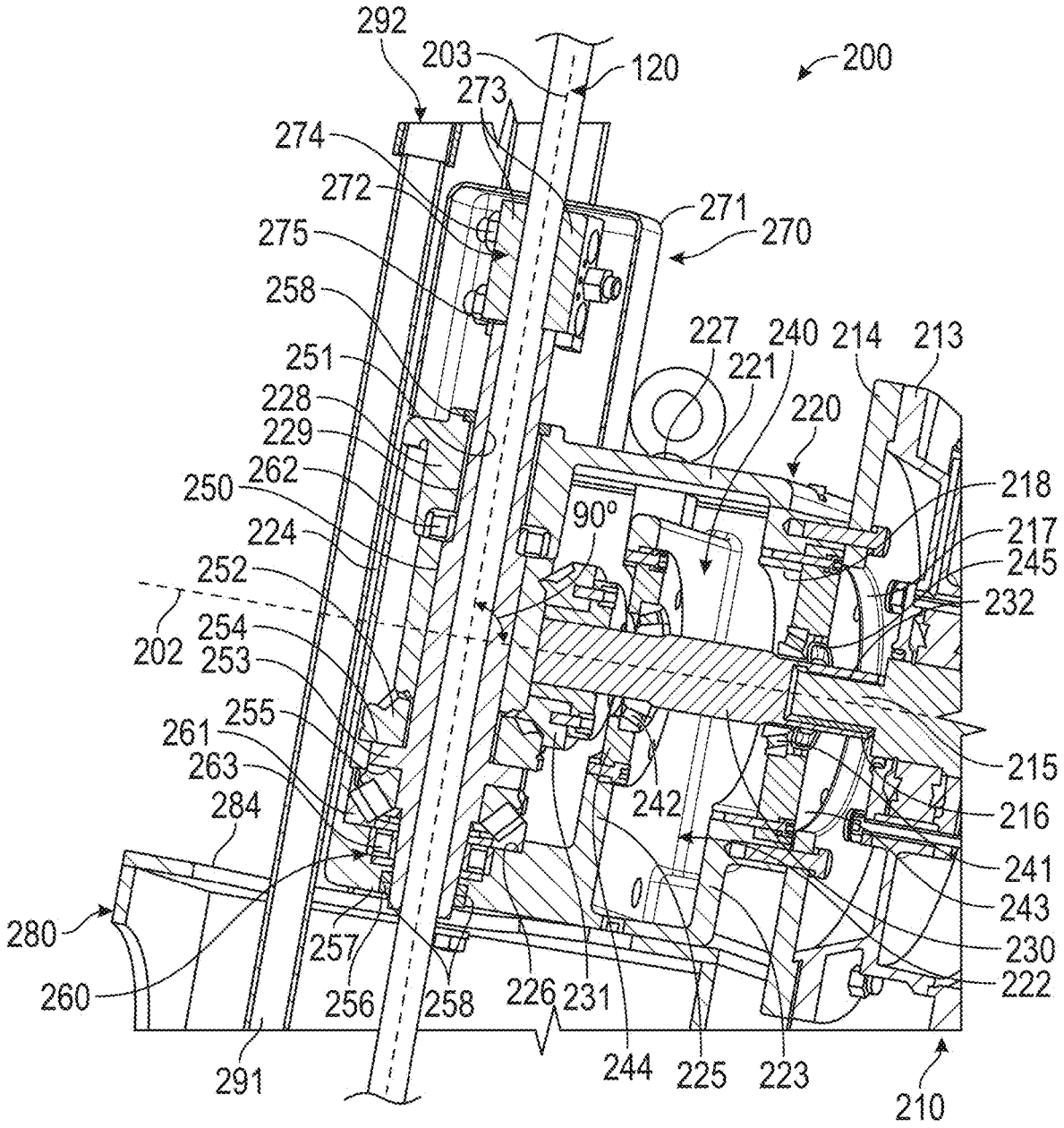
FIG. 2B illustrates a schematic cross-sectional view of the drive unit of FIG. 2A, according to one or more embodiments of the disclosure.
Figure 2C:
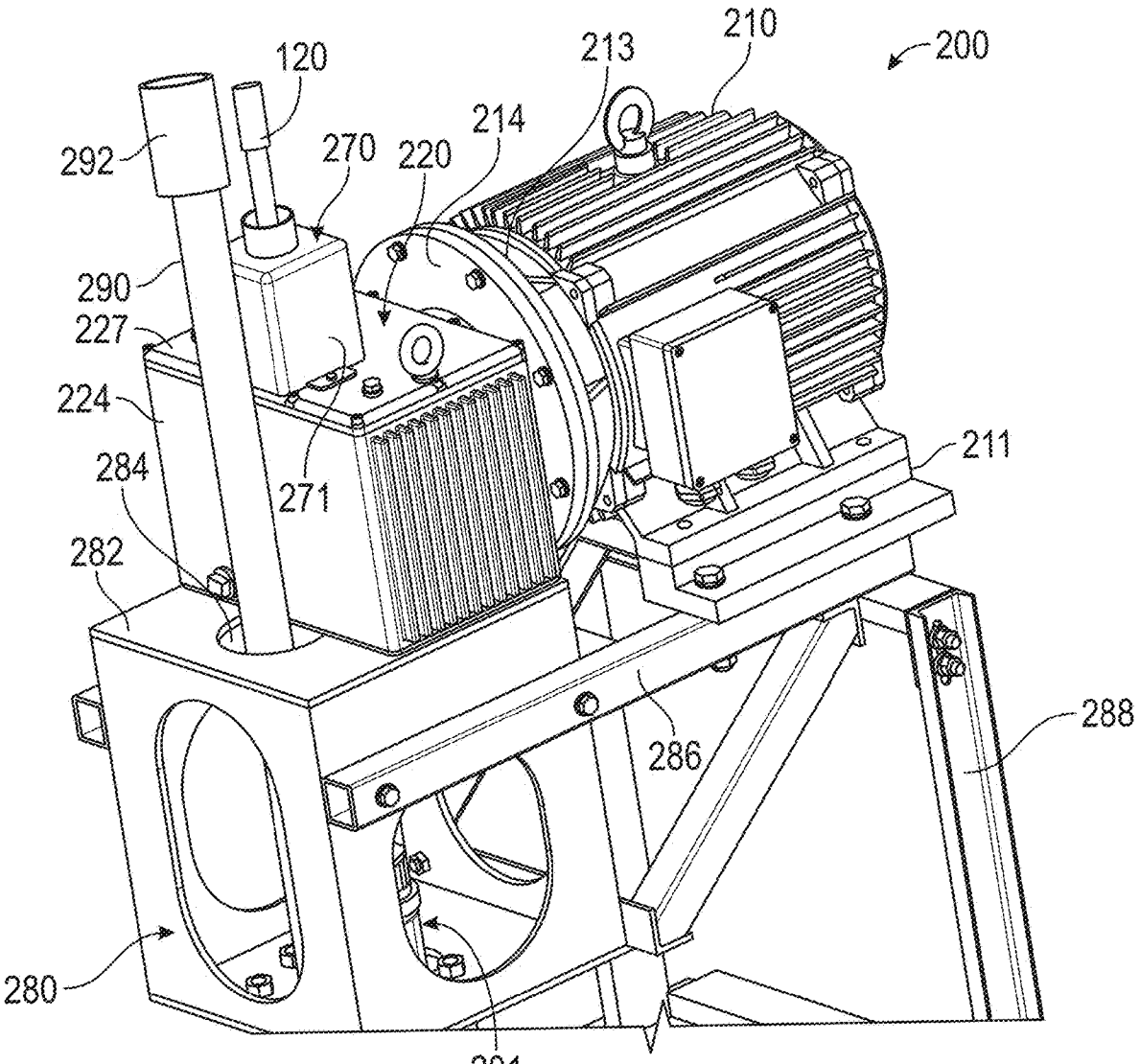
FIG. 2C illustrates a perspective view of the drive unit, according to one or more embodiments of the disclosure.

FIGS. 2A-2C illustrate an exemplary wellhead drive unit 200 that facilitates including two strings in a wellbore 102, such as the PCP string 110 and the second string 190 shown in FIG. 1. The drive unit 200 described herein may be substituted for the drive unit 130 described and shown in FIG. 1.

The drive unit 200 includes a PMM 210, a gearbox 220, a frame 280, and an access tubular 290. The drive unit 200 is coupled to the wellhead 101. In some embodiments, the drive unit 200 is mounted on a dual string blowout preventer ("BOP") 201 which is attached to the wellhead 101. In some embodiments, the drive unit 200 includes the BOP 201.

The PMM 210 is an electric motor that includes permanent magnets. As shown in FIG. 2A, the PMM 210 includes a frame mount 211, such as one or more flanges, to mount the PMM 210 to the frame 280 and a face mount 213, such as a flange, to mount the PMM 210 to the gearbox 220. As shown in FIG. 2B, the PMM 210 also includes a drive shaft 215. A current is supplied to the PMM 210 by the VFD 150 to cause a drive shaft 215 to rotate about a first axis 202 (e.g., drive shaft axis) which causes the rod string 120 to rotate about a second axis 203 (e.g., rod string axis). As shown in FIG. 2B, the first axis 202 is not coaxial with the second axis 203. Rather, the first axis 202 is disposed at an angle relative to the second axis 203. In some embodiments, and as shown in FIG. 2B, the first axis 202 is perpendicular to the second axis 203. In other words, the PMM 210 is oriented horizontally with respect to the axis of rotation of the rod string 120. In some embodiments, the first axis 202 is substantially perpendicular to the second axis 203, such as the angle between the first axis 202 and the second axis being within 2 degrees of 90 degrees, such as within 1.5 degrees of 90 degrees, such as within 1.0 degree of 90 degrees, such as within 0.5 degrees of 90 degrees, and such as within 0.1 degree of 90 degrees.

Conventional PCP systems that use PMMs have the PMM oriented vertically such that the axis of rotation of the drive shaft of the PMM is coaxial with the axis of rotation of the rod string. In other words, the PMM is placed directly above the wellhead. The vertical orientation of the PMM with the rod string inhibits including a second string in the PCP system since the PMM blocks access to the wellhead 101 due to the spatial limitations of the wellhead 101. In other words, a vertical orientation of the PMM places the PMM in the way of the access tubular 290, since the access tubular 290 is positioned close to (such as within 5 inches in some embodiments) of the rod string 120 and may to extend to at least the same height as a portion of the PMM with respect to the wellhead 101. The horizontal orientation of the PMM 210 positions the PMM 210 away from the wellhead 101, such as not being disposed directly above the BOP 201 as shown in FIG. 2A, which allows a second string 190 to be placed in the well 102 through the access tubular 290.

The PMM 210 may be more efficient and consume less power than a conventional electric motor. For example, the PMM 210 can be up to around 97% efficient, allowing for up to around 25% less power consumption compared to an electric motor. The PMM 210 can therefore have a lower operating cost as compared to a conventional electric motor. The PMM 210 can be safer than a conventional motors applications to rotate rod strings because the PMM 210 does not include external moving parts, such as belts. The PMM 210 can advantageously operate with reduced noise and/or vibration. The PMM 210 can provide or allow for improved service life and require less preventive maintenance. In some embodiments, the PMM 210 may be a 45 kW motor. The PMM 210 can provide full torque over its full speed range (for example, 25-500 RPM). For example, the operating torque supplied by the PMM 210 may be 1000 Nm or more. The torque and rotational speed of the PMM 210 can be selected based on the PCP 111.

The gearbox 220 includes various components to facilitate the transfer the rotational power from the drive shaft 215 to the rod string 120. The gearbox 220 includes a housing 221, a rotary shaft 230 (e.g., pinion shaft), a first bearing assembly 240, a tubular shaft 250 (e.g., hollow shaft), a second bearing assembly 260, and a clamp assembly 270.

As shown in FIG. 2B, the housing 221 includes a plurality of walls that partially define an interior chamber 222. The interior chamber 222 may be partially or fully filled with a lubricant. A removable plug may be installed in the housing 221 to allow the lubricant to be placed in the interior chamber 222. The lubricant is in contact with one or more components of the gearbox 220 that is disposed within the housing 221 (e.g., disposed within the interior chamber 222). Similarly, the housing 221 may also include one or more drain plugs to allow the lubricant to be drained from the interior chamber 222. The housing 221 includes a first side 223 facing the PMM 210 and a second side 224 facing the access tubular 290. A gearbox face mount 214 is attached to the first side 223 of the housing by a plurality of fasteners (e.g., bolts). The gearbox face mount 214 may be a flange. The face mount 213 of the PMM 210 is attached to the gearbox face mount 214 by a plurality of fasteners. The drive shaft 215 is disposed in concentric openings 217 of the face mount 213 and the gearbox face mount 214.

The rotary shaft 230 is disposed within the housing 221 within the interior chamber 222 and is rotatable about the first axis 202. A first gear 231 is coupled a first end of the rotary shaft 230. In some embodiments, the rotary shaft 230 includes a recessed portion 232 configured to receive a portion of the drive shaft 215. In some embodiments, the drive shaft 215 may include a spline 216 disposed in a corresponding profile of the recessed portion 232 to rotationally couple the drive shaft 215 and the rotary shaft 230.

The first bearing assembly 240 facilitates the rotation of the rotary shaft 230 about the first axis 202. The first bearing assembly 240 includes a first axial bearing 241 and a second axial bearing 242 engaged with the rotary shaft 230. The first axial bearing 241 and the second axial bearing 242 may be a roller bearing, a ball bearing, or a tapered roller bearing, or any other suitable bearing. The rotary shaft 230 is disposed within the first axial bearing 241 and the second axial bearing 242. The first axial bearing 241 may be disposed in a first bearing housing 243. The first bearing housing 243 is shown attached to the first side 223 to cover an opening 218 in the first side 223 in the housing 221 to enclose the interior chamber 222. A seal element 245 may be disposed between the first side 223 and the first bearing housing 243 to inhibit or prevent the lubricant from leaking from the interior chamber 222. The second axial bearing 242 is disposed around the rotary shaft 230 between the first gear 231 and the first axial bearing 241. The second bearing housing 244 may be attached to a support wall 225, such as being attached by a plurality of fasteners. The support wall 225 extends into the interior chamber 222. The support wall 225 may not completely partition the interior chamber 222 such that lubricant can flow over the top, around the sides, and/or through one or more openings of the support wall 225.

Vertically oriented PMMs require a thrust bearing about the drive shaft of the PMM to bear the axial load of the rod string 120. The first bearing assembly 240 does not include a thrust bearing, such as a thrust bearing engaged with the drive shaft 215 or the rotary shaft 230, since axial load of the rod string 120 is not acting on the drive shaft 215 and the rotary shaft 230. In other words, a horizontally oriented PMM eliminates the need for a thrust bearing about the drive shaft 215 of the PMM 210.

The tubular shaft 250 (e.g., hollow shaft) is at least partially disposed in the housing 221. The tubular shaft 250 includes an inner surface defining a bore 251 and a gear mount 253 disposed on or integral with the exterior surface of the tubular shaft 250. A portion of the rod string 120 is disposed in the bore 251. For example, the bore 251 may be sized to receive a 1.25 inch diameter rod string 120. As will be described below, the rod string 120 is rotationally coupled to the tubular shaft 250 such that rotation of the tubular shaft 250 about the second axis 203 causes the rod string 120 to rotate about the second axis 203.

The tubular shaft 250 is partially received in a bore 229 of a tubular shaft support 228 of the top side 227 of the housing 221. The tubular shaft 250 is also partially received in an opening 256 formed in a lower side 257 of the housing 221. At least one seal element 258 is disposed within the opening 256 to inhibit or prevent the lubricant from leaking from the interior chamber 222. For example, FIG. 2B illustrates two lip seal elements 258 within the opening 256 and engaged with the tubular shaft 250. Another seal element 258 may be located on the top side 227 of the housing 221 at the entrance of the bore 229 in engagement with the tubular shaft 250 to inhibit lubricant from leaking out of the housing 221 through the bore 229.

A second gear 252 is rotationally connected to the tubular shaft 250, such as being attached to the gear mount 253. In some embodiments, and as shown in FIG. 2B, the gear mount 253 includes an upper shoulder 254 and a lower shoulder 255. The second gear 252 is shown engaged with the upper shoulder 254 of the gear mount 253. In some embodiments, the second gear 252 is rotationally coupled to the tubular shaft 250 by or more fasteners inserted through the gear mount 253 and into the second gear 252. In some embodiments, the gear mount 253 may include a spline or key coupled to tubular shaft 250 that rotationally connects the second gear 252 to the tubular shaft 250.

The first gear 231 and the second gear 252 are engaged. FIG. 2B shows the first gear 231 and the second gear 252 intersect at a 90 degree angle. In some embodiments, and as shown in FIG. 2B, the first gear 231 and second gear 252 have a 1:1 ratio. In some embodiments, the first gear 231 and second gear 252 are bevel gears, such as miter gears. Rotation of the first gear 231 about the first axis 202 causes the second gear 252 to rotate about the second axis 203, thereby causing the tubular shaft 250 and the rod string 120 rotationally connected thereto to rotate about the second axis 203.

The second bearing assembly 260 facilitates the rotation of the tubular shaft 250 about the second axis 203. The second bearing assembly 260 includes a first radial bearing 261, a second radial bearing 262, and a thrust bearing 263. The tubular shaft 250 is disposed within the first radial bearing 261, the second radial bearing 262, and the thrust bearing 263. The first radial bearing 261 is engaged with a lower interior surface 226 of the interior of the housing 221. The second radial bearing 262 is coupled to the tubular shaft support 228, such as being partially disposed in a recess formed within the tubular shaft support 228.

The thrust bearing 263 bears the axial load of the rod string 120 that is rotationally coupled to the tubular shaft 250. The thrust bearing 263 is engaged with the lower shoulder 255 of the gear mount 253 and the lower interior surface 226 of the interior of the housing 221. In some embodiments, and as shown in FIG. 2B, the thrust bearing 263 is disposed between the gear mount 253 and the second radial bearing 262.

In some embodiments, the first radial bearing 261 and the second radial bearing 262 may be a roller bearing, a ball bearing, or a tapered roller bearing, or any other suitable bearing. The thrust bearing 263 may be a roller thrust bearing, a ball thrust bearing, or any other suitable thrust bearing.

The gearbox 220 advantageously does not need belts, sheaves, or bushings to facilitate the transfer of rotational power from the drive shaft 215 to the rod string 120. Additionally, the brake (part of the VFD 150) is external to the gearbox 220 and PMM 210. Therefore, the drive unit 200 has reduced maintenance needs as compared to conventional drive units used to drive a rod string 120.

The clamp assembly 270 is coupled to the gearbox 220. The clamp assembly 270 may include a housing 271 (e.g., clamp safety guard) that is coupled to the top side 227 of the housing 221. The clamp assembly 270 further includes a clamp 272 that is configured to rotationally connect the rod string 120 to the tubular shaft 250. The clamp 272 may include opposing clamps 273, such as opposing clamp plates, which may be tightened together by a plurality of fasteners 274. The fasteners may be tightened in a sequence to a desired torque to secure the rod string 120 to the tubular shaft 250. The clamp 272 also includes a clamp profile 275. The clamp profile 275 facilitates interlocking the clamp 272 to the tubular shaft 250 and to the rod string 120 to rotationally couple the rod string 120 to the tubular shaft 250. For example, the clamp profile 275 may be faces of the clamp 272 that interlock with a corresponding profile, such as a square or rectangular profile, of the tubular shaft 250 and the rod string 120.

The frame 280 includes a base 282 and one or more motor supports 286. The gearbox 220 is attached (e.g., mounted) to the base 282, such as the upper surface of the base 282. The frame mount 211 of the PMM 210 is mounted to the one or more motor supports 286 extending from the base 282. The base 282 may engaged with the wellhead 101, such as being engaged with the BOP 201. The frame 280 may also include one or more wellhead supports 288 attached to the motor supports 286. The wellhead supports 288 may be attached to the wellhead 101 or may be fixed to the ground or concrete near the wellhead 101.

The base 282 includes at least one opening 284 as shown in FIGS. 2A-2C. In some embodiments, the base 282 includes an opening 284 that is at least partially disposed underneath the gearbox 220, as shown in FIG. 2B, such that the tubular shaft 250 is disposed above the opening 284. In some embodiments, and as shown in FIG. 2B, the tubular shaft 250 is partially disposed in the opening 284. In some embodiments, the tubular shaft 250 is not partially disposed in the opening 284. The opening 284 allows the rod string 120, which is disposed therein, to be disposed within tubular shaft 250 and allows for the access tubular 290 to be disposed above the wellhead 101, such as being positioned on the BOP 201. The opening 284 may be an opening completely bounded by a surface of the base 282, such as a being a circular, an oval, or a square opening. In some embodiments, the opening 284 is partially bounded by a surface of the base 282, such as being a C-shaped or U-shaped opening. In some embodiments, the base 282 includes one opening 284 that both the rod string 120 and access tubular 290 are disposed within. In some embodiments, the base 282 includes separate openings 284 for the rod string 120 and the access tubular 290.

The access tubular 290 has an inner surface defining a bore 291 to receive the second string 190. The access tubular 290 is configured to allow a second string 190 to be disposed within, such as being run into, the wellbore 102 while the PCP string 110 is disposed within the wellbore 102. In other words, a second operation may be conducted in the wellbore 102 while the PMM 210 is being operated to cause the PCP 111 to pump the fluid 106 to the surface through the PCP string 110. The access tubular 290 is disposed within the opening 284 and is arranged parallel to the rod string 120 and the tubular shaft 250. In other words, the access tubular 290 is oriented such that the longitudinal axis of the access tubular 290 is parallel to the second axis 203. The access tubular 290 may be partially disposed within or mounted to the wellhead 101, such as being partially disposed within or mounted to the BOP 201. In some embodiments, and as shown in FIGS. 2A-2C, an upper end 292 of the access tubular 290 is positioned above a portion of the gearbox 220 and PMM 210. In other words, the access tubular 290 may be taller relative to the wellhead 101 than the uppermost portion of the gearbox 220, clamp assembly 270, or PMM 210. Additionally, the access tubular 290 may be positioned and/or sized such that the first axis 202 passes through the access tubular 290 as shown in FIG. 2B. The lower end of the access tubular 290 is coupled to the BOP 201.

Example Aspects

Implementation examples are described in the following numbered aspects:

Aspect 1: A progressive cavity pump system, comprising: a pump string disposed in a wellbore, the pump string including a progressive cavity pump and a rod string, wherein the rod string is rotatable about a first axis to rotate a rotor of the progressive cavity pump; and a permanent magnetic motor ("PMM") configured to drive rotation of the rod string, wherein the PMM is oriented such that a drive shaft of the PMM rotates about a second axis that is not coaxial with the first axis.

Aspect 2: The progressive cavity pump system of Aspect 1, comprising: a gearbox configured to transfer rotational power of the drive shaft to the rod string, the gearbox including a gearbox mount; and the PMM including a face mount, wherein the face mount of the PMM is mounted to the gearbox mount.

Aspect 3: The progressive cavity pump system of any combination of Aspects 1-2, comprising: a frame, wherein the PMM further comprises a frame mount that is mounted to the frame.

Aspect 4. The progressive cavity pump system of any combination of Aspects 1-3, comprising: a second string disposed in the wellbore with the pump string, wherein the second string is partially disposed in an access tubular disposed in an opening of the frame.

Aspect 5: A wellhead drive unit, comprising: a permanent magnetic motor (PMM) including a drive shaft rotatable about a first axis; a tubular shaft including an outer surface and a first inner surface defining a first bore, the tubular shaft rotatable about a second axis that is substantially perpendicular to the first axis, and wherein the tubular shaft is configured to receive a rod string; a rotary shaft rotationally connected to the drive shaft, wherein rotation of the drive shaft rotates the rotary shaft about the first axis; a first gear rotationally connected to the rotary shaft, wherein rotation of the rotary shaft causes the first gear to rotate about the first axis; and a second gear engaged with the first gear and rotationally connected to the tubular shaft, wherein rotation of the first gear causes the second gear and the tubular shaft to rotate about the second axis.

Aspect 6: The wellhead drive unit of Aspect 5, further comprising: a frame assembly including a base, the base including an opening; an access tubular disposed in the opening and oriented such that a longitudinal axis thereof is parallel to the second axis, wherein the access tubular includes a second inner surface defining a second bore; and the tubular shaft is disposed above the opening and aligned with the opening.

Aspect 7. The wellhead drive unit of any combination of Aspects 5-6, further comprising: a housing attached to the base, wherein an inner surface of the housing defines an interior chamber configured to receive a lubricant, and wherein the rotary shaft and tubular shaft are disposed in the housing.

Aspect 8: The wellhead drive unit of any combination of Aspects 5-7, wherein the frame assembly includes at least one support member coupled to the base, and the permanent magnetic motor further comprises: a first mount attached to a face mount of the housing, the first mount including a first mount opening, wherein the drive shaft is disposed in the first mount opening; and a second mount attached to the at least one support member.

Aspect 9: The wellhead drive unit of any combination of Aspects 5-8, further comprising: a first bearing assembly comprising a first bearing and a second bearing, wherein the rotary shaft is disposed in the first bearing and the second bearing; and a second bearing assembly comprising a thrust bearing, a first radial bearing, and a second radial bearing, wherein the tubular shaft is disposed within the thrust bearing, first radial bearing, and the second radial bearing.

Aspect 10: The wellhead drive unit of any combination of Aspects 5-9, wherein rotary shaft is rotationally connected to the drive shaft by a spline formed on the drive shaft that is engaged with the rotary shaft.

Aspect 11: The wellhead drive unit of any combination of Aspects 5-10, further comprising: a clamp engaged with a first end of the tubular shaft, wherein the clamp is configured to rotationally connect the rod string to the tubular shaft.

Aspect 12: The wellhead drive unit of any combination of Aspects 5-11, wherein the PMM receives a current from a variable frequency drive to cause the PMM to rotate the drive shaft about the first axis.

Aspect 13: A wellhead drive unit comprising: a frame comprising a base and at least one motor support; a permanent magnetic motor ("PMM") comprising a drive shaft that is rotatable about a first axis, a frame mount mounted to the at least one motor support, and a face mount; a gearbox mounted to the base, the gearbox comprising: a housing defining an interior chamber configured to receive a lubricant, the housing comprising a gearbox mount, and wherein the face mount of the PMM is mounted to the gearbox mount; a rotary shaft disposed in the housing and rotationally connected to the drive shaft, wherein the drive shaft and rotary shaft rotate about the first axis; a first bearing assembly comprising a first bearing and a second bearing, wherein the rotary shaft is disposed within first bearing and the second bearing; a tubular shaft comprising an outer surface and an inner surface defining a bore, wherein the bore is configured to receive a portion of a rod string, and wherein the tubular shaft is rotatable about a second axis, the second axis being substantially perpendicular to the first axis; a first gear rotationally connected to the rotary shaft, wherein rotation of the rotary shaft causes the first gear to rotate about the first axis; a second gear engaged with the first gear and rotationally connected to the tubular shaft, wherein rotation of the first gear causes the second gear and the tubular shaft to rotate about the second axis; and a second bearing assembly comprising a thrust bearing, a first radial bearing, and a second radial bearing, wherein the tubular shaft is disposed within the thrust bearing, first radial bearing, and the second radial bearing.

Aspect 14: The wellhead drive unit of Aspect 13, wherein rotary shaft is rotationally connected to the drive shaft by a spline formed on the drive shaft that is engaged with the rotary shaft.

Aspect 15: The wellhead drive unit of any combination of Aspects 13-14, further comprising: a clamp engaged with a first end of the tubular shaft, wherein the clamp is configured to rotationally connect the rod string to the tubular shaft.

Aspect 16: The wellhead drive unit of any combination of Aspects 13-15, further comprising: an access tubular disposed in an opening in the base and oriented such that a longitudinal axis thereof is parallel to the second axis, wherein the access tubular includes a second inner surface defining a second bore.

Aspect 17: A method of operating a progressive cavity pump system, comprising: rotating a drive shaft of a permanent magnetic motor ("PMM") about a first axis; transferring rotational power of the drive shaft to a rod string of a pump string disposed in a wellbore, thereby rotating the rod string about a second axis to rotate a rotor of a progressive cavity pump disposed at an end of the pump string, wherein the second axis is not coaxial with the first axis.

Aspect 18: The method of Aspect 17, further comprising: conducting an operation in the wellbore with a second string while rotating the rod string.

Aspect 19: The method of Aspect 18, wherein the operation is delivering chemicals at a depth in the wellbore with the second string.

Aspect 20: The method of Aspect 18, wherein the second string is a wireline string including a wireline and a wireline tool coupled to the wireline.

It is contemplated that any one or more elements or features of any one disclosed embodiment or example may be beneficially incorporated in any one or more other non-mutually exclusive embodiments or examples. While the foregoing is directed to embodiments of the present disclosure, other and further embodiments of the disclosure may be devised without departing from the basic scope thereof, and the scope thereof is determined by the claims that follow.

The following claims are not intended to be limited to the aspects shown herein, but are to be accorded the full scope consistent with the language of the claims. Within a claim, reference to an element in the singular is not intended to mean "one and only one" unless specifically so stated, but rather "one or more." Unless specifically stated otherwise, the term "some" refers to one or more. No claim element is to be construed under the provisions of 35 U.S.C. § 112(f) unless the element is expressly recited using the phrase "means for". All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims.

What is claimed is:

1. A wellhead drive unit, comprising:

a permanent magnetic motor (PMM) including a drive shaft rotatable about a first axis;

a tubular shaft including an outer surface and a first inner surface defining a first bore, the tubular shaft rotatable about a second axis that is substantially perpendicular to the first axis, and wherein the tubular shaft is configured to receive a rod string;

a frame assembly including a base, the base including an opening, and the tubular shaft being disposed above the opening and aligned with the opening;

an access tubular disposed in the opening and oriented such that a longitudinal axis thereof is parallel to the second axis, wherein the access tubular includes a second inner surface defining a second bore;

a rotary shaft rotationally connected to the drive shaft, wherein rotation of the drive shaft rotates the rotary shaft about the first axis;

a first gear rotationally connected to the rotary shaft, wherein rotation of the rotary shaft causes the first gear to rotate about the first axis; and a second gear engaged with the first gear and rotationally connected to the tubular shaft, wherein rotation of the first gear causes the second gear and the tubular shaft to rotate about the second axis.

2. The wellhead drive unit of claim 1, further comprising:

a housing attached to the base, wherein an inner surface of the housing defines an interior chamber configured to receive a lubricant, and wherein the rotary shaft and tubular shaft are disposed in the housing.

3. The wellhead drive unit of claim 2, wherein the frame assembly includes at least one support member coupled to the base, and the permanent magnetic motor further comprises:

a first mount attached to a face mount of the housing, the first mount including a first mount opening, wherein the drive shaft is disposed in the first mount opening; and a second mount attached to the at least one support member.

4. The wellhead drive unit of claim 1, further comprising:

a first bearing assembly comprising a first bearing and a second bearing, wherein the rotary shaft is disposed in the first bearing and the second bearing; and a second bearing assembly comprising a thrust bearing, a first radial bearing, and a second radial bearing, wherein the tubular shaft is disposed within the thrust bearing, first radial bearing, and the second radial bearing.

5. The wellhead drive unit of claim 1, wherein the rotary shaft is rotationally connected to the drive shaft by a spline formed on the drive shaft that is engaged with the rotary shaft.

6. The wellhead drive unit of claim 1, further comprising:

a clamp engaged with a first end of the tubular shaft, wherein the clamp is configured to rotationally connect the rod string to the tubular shaft.

7. The wellhead drive unit of claim 1, wherein the PMM receives a current from a variable frequency drive to cause the PMM to rotate the drive shaft about the first axis.

8. A wellhead drive unit comprising:

a frame comprising a base and at least one motor support;

a permanent magnetic motor ("PMM") comprising a drive shaft that is rotatable about a first axis, a frame mount mounted to the at least one motor support, and a face mount;

a gearbox mounted to the base, the gearbox comprising:

a housing defining an interior chamber configured to receive a lubricant, the housing comprising a gearbox mount, and wherein the face mount of the PMM is mounted to the gearbox mount;

a rotary shaft disposed in the housing and rotationally connected to the drive shaft, wherein the drive shaft and rotary shaft rotate about the first axis;

a first bearing assembly comprising a first bearing and a second bearing, wherein the rotary shaft is disposed within first bearing and the second bearing;

a tubular shaft comprising an outer surface and an inner surface defining a bore, wherein the bore is configured to receive a portion of a rod string, and wherein the tubular shaft is rotatable about a second axis, the second axis being substantially perpendicular to the first axis;

a first gear rotationally connected to the rotary shaft, wherein rotation of the rotary shaft causes the first gear to rotate about the first axis;

a second gear engaged with the first gear and rotationally connected to the tubular shaft, wherein rotation of the first gear causes the second gear and the tubular shaft to rotate about the second axis; and a second bearing assembly comprising a thrust bearing, a first radial bearing, and a second radial bearing, wherein the tubular shaft is disposed within the thrust bearing, first radial bearing, and the second radial bearing.

9. The wellhead drive unit of claim 8, wherein rotary shaft is rotationally connected to the drive shaft by a spline formed on the drive shaft that is engaged with the rotary shaft.

10. The wellhead drive unit of claim 9, further comprising:

a clamp engaged with a first end of the tubular shaft, wherein the clamp is configured to rotationally connect the rod string to the tubular shaft.

11. The wellhead drive unit of claim 9, further comprising:

an access tubular disposed in an opening in the base and oriented such that a longitudinal axis thereof is parallel to the second axis, wherein the access tubular includes a second inner surface defining a second bore.

12. A wellhead drive unit, comprising:

a permanent magnetic motor (PMM) including a drive shaft rotatable about a first axis;

a tubular shaft including an outer surface and a first inner surface defining a first bore, the tubular shaft rotatable about a second axis that is substantially perpendicular to the first axis, and wherein the tubular shaft is configured to receive a rod string;

a clamp engaged with a first end of the tubular shaft, wherein the clamp is configured to rotationally connect the rod string to the tubular shaft;

a rotary shaft rotationally connected to the drive shaft, wherein rotation of the drive shaft rotates the rotary shaft about the first axis;

a first gear rotationally connected to the rotary shaft, wherein rotation of the rotary shaft causes the first gear to rotate about the first axis; and a second gear engaged with the first gear and rotationally connected to the tubular shaft, wherein rotation of the first gear causes the second gear and the tubular shaft to rotate about the second axis.

13. The wellhead drive unit of claim 12, wherein the PMM receives a current from a variable frequency drive to cause the PMM to rotate the drive shaft about the first axis.

14. The wellhead drive unit of claim 12, wherein the rotary shaft is rotationally connected to the drive shaft by a spline formed on the drive shaft that is engaged with the rotary shaft.

15. The wellhead drive unit of claim 12, further comprising:

a first bearing assembly comprising a first bearing and a second bearing, wherein the rotary shaft is disposed in the first bearing and the second bearing; and a second bearing assembly comprising a thrust bearing, a first radial bearing, and a second radial bearing, wherein the tubular shaft is disposed within the thrust bearing, first radial bearing, and the second radial bearing.

* * * * *